US006929538B2

(12) United States Patent
Yi

(10) Patent No.: US 6,929,538 B2
(45) Date of Patent: Aug. 16, 2005

(54) POWER TOOL WITH A CLAMPING DEVICE FOR AXIALLY SECURING A DISK SHAPED TOOL

(75) Inventor: Zhiyong Yi, Suzhou (CN)

(73) Assignee: Positec Power Tools (Suzhou) Co., Ltd., Suzhou (CN)

( * ) Notice: Subject to any disclaimer, the term of this patent is extended or adjusted under 35 U.S.C. 154(b) by 25 days.

(21) Appl. No.: 10/462,081

(22) Filed: Jun. 13, 2003

(65) Prior Publication Data

US 2004/0043714 A1 Mar. 4, 2004

(30) Foreign Application Priority Data

Jun. 13, 2002 (CN) ..... 02262436 U

(51) Int. Cl.[7] ..... B24B 27/08
(52) U.S. Cl. ..... 451/359; 451/509
(58) Field of Search ..... 451/359, 342, 451/508, 509, 510

(56) References Cited

U.S. PATENT DOCUMENTS 2,993,311 A * 7/1961 West ..... 464/120
4,516,358 A * 5/1985 Marton et al. ..... 451/357
5,558,571 A * 9/1996 Toyoshima et al. ..... 451/358
5,584,753 A * 12/1996 Takahashi ..... 451/342
5,620,364 A * 4/1997 Torrance et al. ..... 451/359
5,733,183 A * 3/1998 Schierling et al. ..... 451/508
5,839,950 A * 11/1998 Johansson Edling et al. .... 451/359
6,042,461 A * 3/2000 Pearson ..... 451/359
6,110,027 A * 8/2000 Muller ..... 451/359
6,116,996 A * 9/2000 Yanase ..... 451/359
6,132,300 A * 10/2000 Martin ..... 451/357
6,277,012 B1 * 8/2001 Halliley ..... 451/359
6,332,836 B1 * 12/2001 Tseng ..... 451/359

* cited by examiner

*Primary Examiner*—M. Rachuba
(74) *Attorney, Agent, or Firm*—Hedman & Costigan, P.C.

(57) ABSTRACT

A clamping device for a power tool that axially secures a disc shaped tool to its spindle. The clamping device securely attaches a grinding wheel or circular saw to a power tool by a contact surface on the clamping device and a screw-on flange that directly contacts the tool. The clamping device counteracts inertial forces that loosen the tool upon sudden deceleration.

4 Claims, 9 Drawing Sheets

B–B
Fig.10
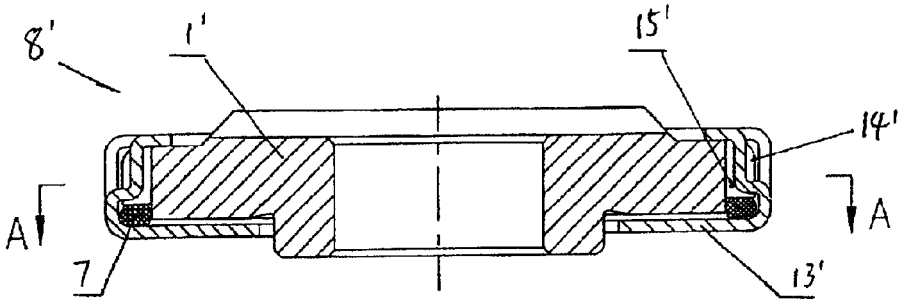
A–A
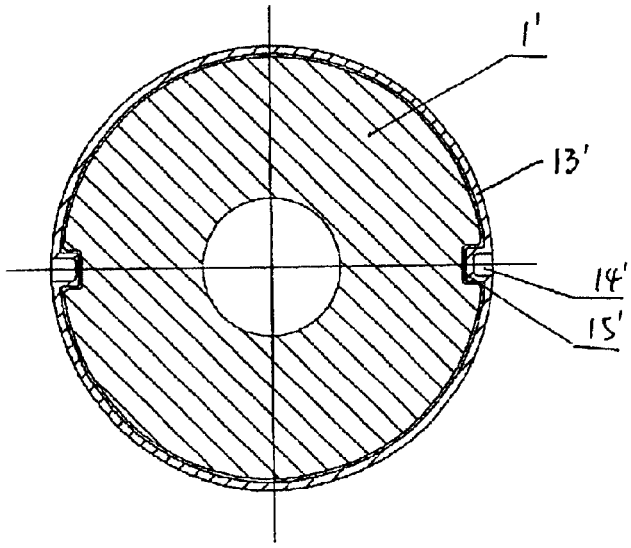
Fig.11

POWER TOOL WITH A CLAMPING DEVICE FOR AXIALLY SECURING A DISK SHAPED TOOL

CROSS REFERENCE TO RELATED APPLICATIONS

STATEMENT REGARDING FEDERALLY SPONSORED RESEARCH OR DEVELOPMENT

INCORPORATION-BY-REFERENCE OF MATERIAL SUBMITTED ON A COMPACT DISC

BACKGROUND OF THE INVENTION

Technical Field

The present invention relates to a power tool with a clamping device for axially securing a disk shaped The present invention relates to a power tool with a clamping device for axially securing a disk shaped tool, particularly a power tool with a clamping device for axially securing a grinding wheel to a spindle of said power tool, such as angle grinder, circular saw and miter saw etc.

Background Information

In the prior art, U.S. Pat. No. 5,545,078 has disclosed a clamping device, the operating element is held between a flange which is disposed on one side of a grinding wheel and a clamping device which is disposed on the other side of said grinding wheel, a disc spring is disposed in said clamping device, further said clamping device includes a clamping and friction element, an axial ring and a disc shaped part. With a power tool have a spindle stop at an extremely high rotating speed, said stop block the spindle abruptly, shortly before it comes a dead stop, with the consequence that the grinding wheel rotates further because of its mass inertia, and the grinding wheel makes its clamping device slightly rotate with respect to the spindle and makes the clamping device loosen and the contact surface which is pressed against the grinding wheel has a tendency of departing from the grinding wheel, and because of the elastic force coming from the disc spring, the clamping device is still pressed against the grinding wheel and exerted a friction force to the grinding wheel, so as to keep itself fastened. The clamping device of this design need to be fastened after several times stops and starts, so it is inconvenient in use. If the power tool stops and starts too many times while the clamping device is not fastened, the clamping device has the possibility of loosing from the spindle, it is insecurity.

BRIEF SUMMARY OF THE INVENTION

The present invention is to provide a new, improved and reliable disc shaped tool clamping device, particularly provides a clamping device which can fasten the tool with respect to the spindle when the tool abruptly stops at a very high speed.

The technical proposal of the present invention is: a power tool with a clamping device for disc shaped tool, which comprises:

A housing;

A spindle with thread;

A tool;

A clamping device and a flange which are disposed on two respective sides of said tool, said flange and said clamping device clamp the tool therebetween and which are secured to a spindle by thread, said clamping device includes a first clamping part and a second clamping part, an elastic element is disposed between said first clamping part and said second clamping part, a first clamping contact surface which is formed on said first clamping part, a second clamping contact surface which is formed on said flange, said disc shaped tool is clamped between said first clamping contact surface and said second clamping contact surface. During fastening, only is said first clamping contact surface which is formed on said first clamping part pressed against said disc shaped tool, an anti-rotating structure is provided between said first clamping part and said second clamping part, an anti-rotating structure is disposed between said first clamping part and said second clamping part.

The present invention owns the following advantages:

By clamping said disc shaped tool between said first clamping part and said flange, a big enough and almost unchangeable pressing force coming from the elastic element will exert on said disc shaped tool, so loosening happens to neither said flange nor said clamping device, thus a security fastener or a clamping device for disc shaped tool is supplied to the operator of said power tool.

BRIEF DESCRIPTION OF THE SEVERAL VIEWS OF THE DRAWINGS

FIG. 10 shows a main sectional view of the clamping device of a second embodiment of the power tool;

FIG. 11 shows a top view of the clamping device of a second embodiment of the power tool.

Figure 1:
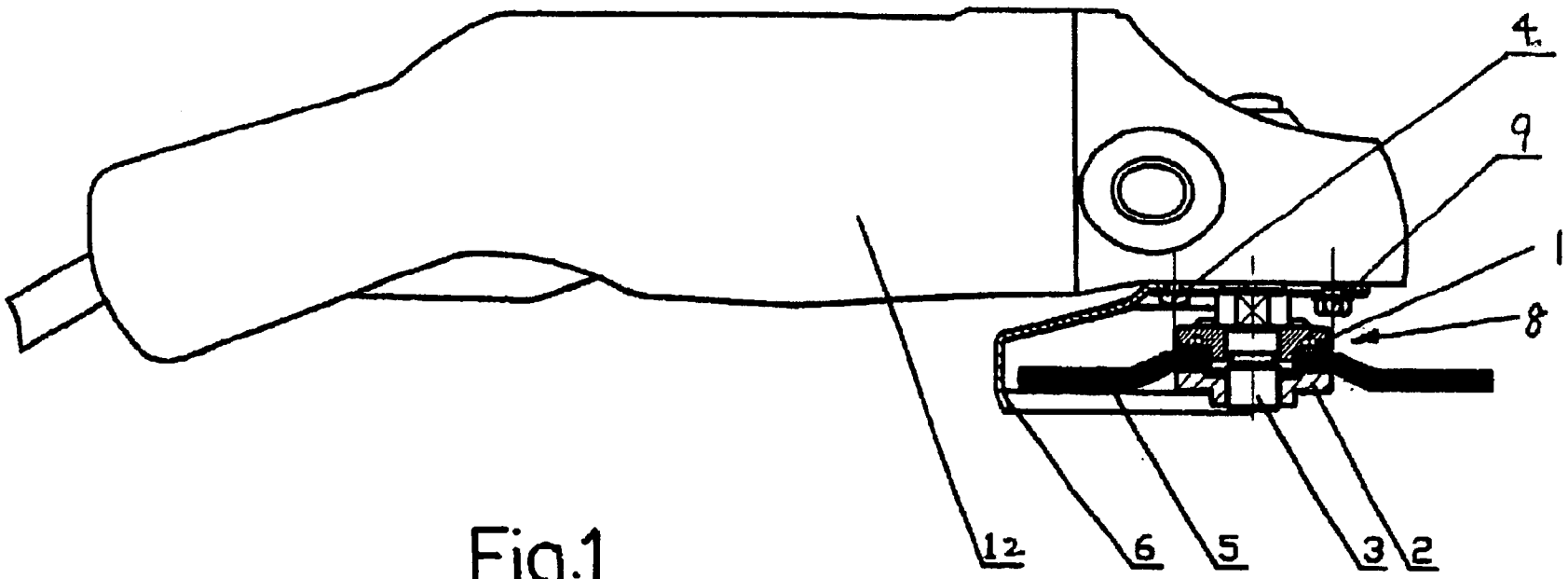
FIG. 1 shows a side view of the power tool with a disc shaped tool should be fastened.
Figure 2:
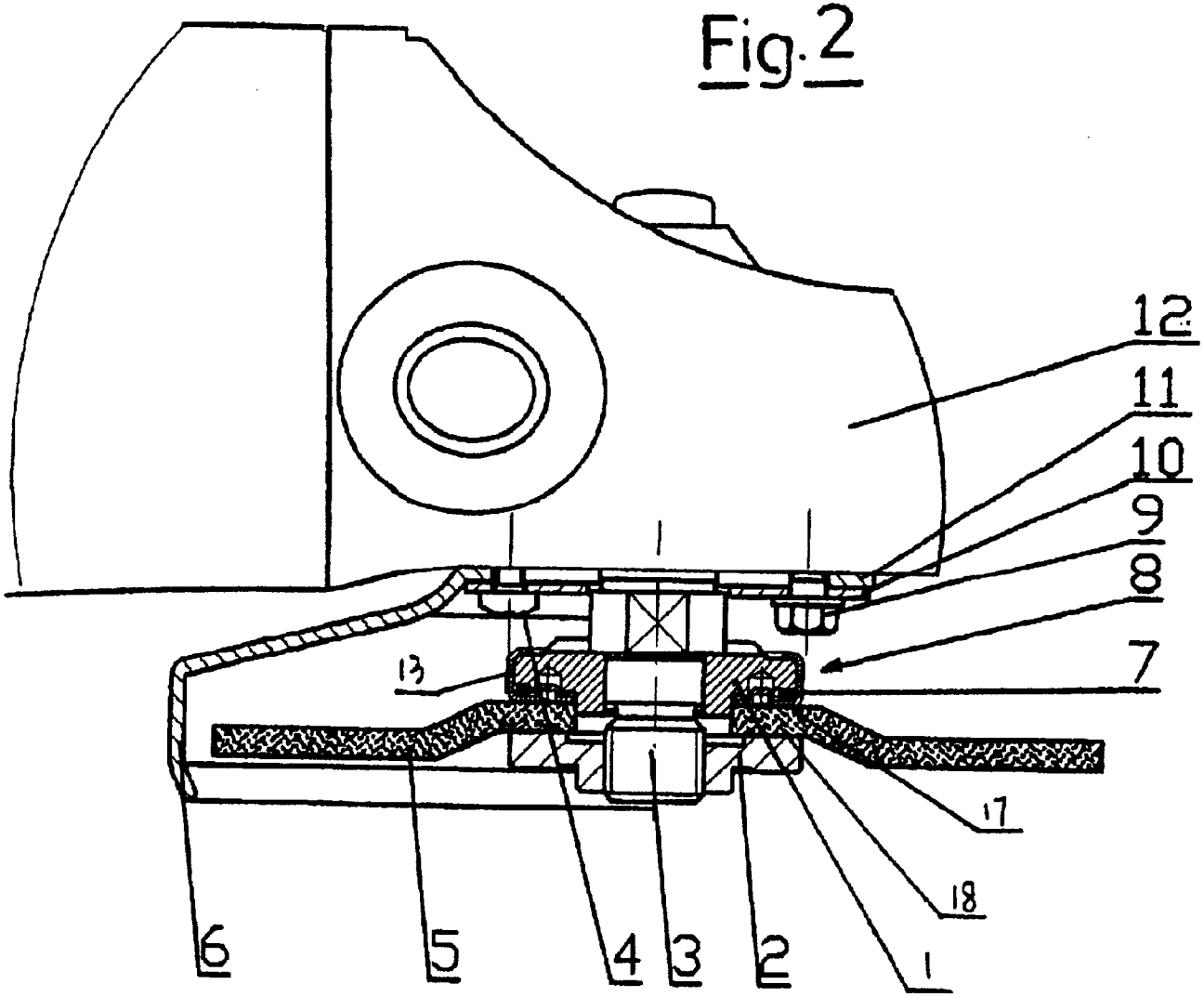
FIG. 2 shows a partly sectional view of the power tool with a disc shaped tool should be fastened.
Figure 3:
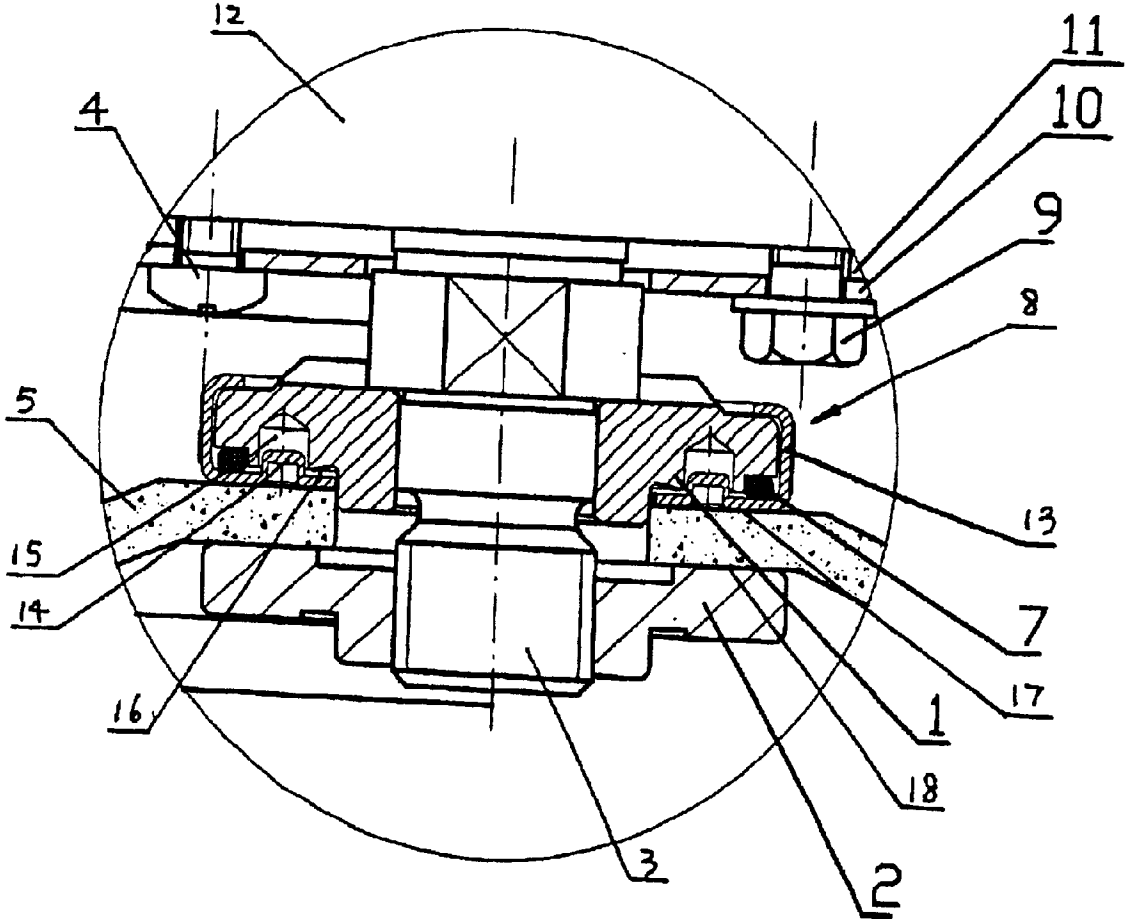
FIG. 3 shows a further enlarged sectional view of the clamping device of FIG. 2.
Figure 4:
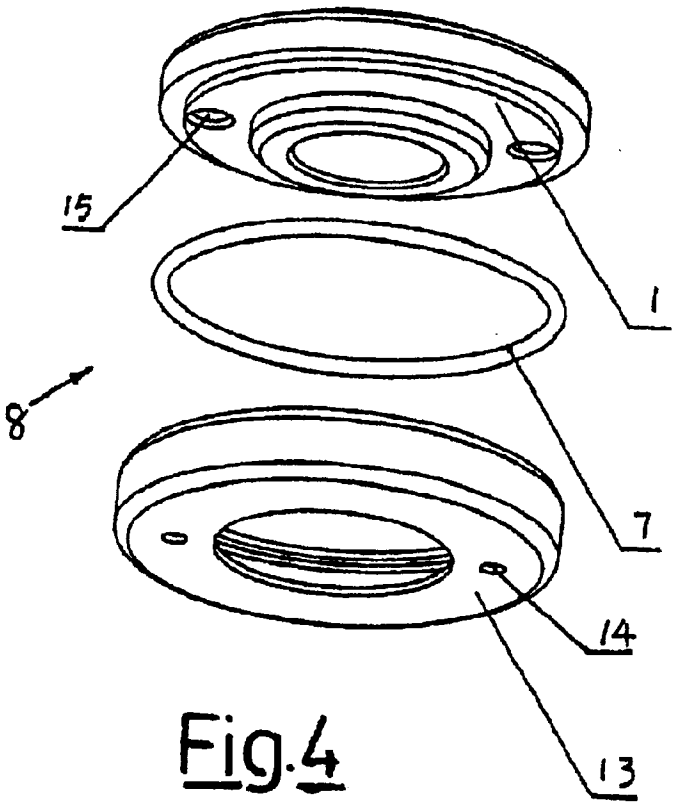
FIG. 4 shows the exploded view of the clamping device.
Figure 5:
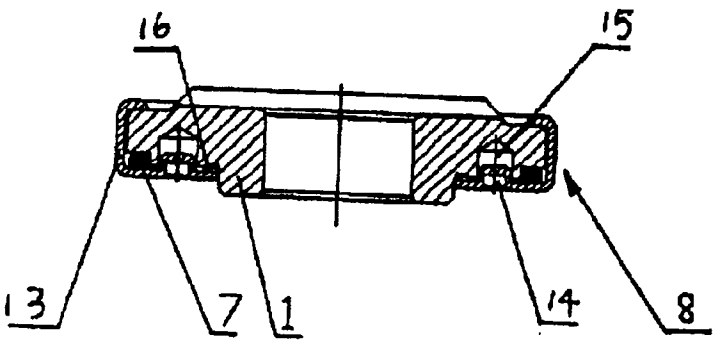
FIG. 5 shows a main sectional view of the clamping device.

In all the FIGS., the numbers respectively indicate to: [1] a second clamping part; [2] a flange; [3] a spindle; [4] the screws; [5] a disc shaped tool; [6] a guard; [7] a elastic element; [8] a clamping device; [9] a bolt; [10] a plate; [11] a transmission reducer casing; [12] a housing; [13] a first clamping part; [14] the anti-rotating protrusions; [15] the anti-rotating bores; [16] a clearance; [17] a first clamping contact surface; [18] a second clamping contact surface; [1'] a second clamping part of the second embodiment; [13'] a first clamping part of the second embodiment; [8] a clamping device of the second embodiment; [14'] the anti-rotating protrusions of the second embodiment; [15] the anti-rotating outwardly opened notches of the second embodiment;

DETAILED DESCRIPTION OF THE INVENTION

See the attached FIG.s, the present invention is a power tool with a clamping device for axially securing a disc shaped tool to the spindle of said power tool, said power tool comprises:

A housing which can be a housing of a grinder or a housing of a circular saw or a housing of a miter saw or a housing of a bench grinder, etc.;

A spindle (3) with thread which is driven by a motor;

A disc shaped tool, for a grinder or a bench grinder, said tool would be a grinding wheel, for miter saws or circular saws, said tool would be a saw blade;

A clamping device (8) and a flange (2) respectively are disposed on each side of said disc shaped tool (5), said clamping device (8) and said flange (2) clamp said disc shaped tool therebetween, and said flange (2) is secured to said spindle (3) by thread;

Said clamping device (8) includes a first clamping part (13) and a second clamping part (1), an elastic element (7) is provided between said first clamping part (13) and said second clamping part (1), said first clamping part (13) has a first clamping contact surface (17), said flange has a second clamping contact surface (18), said disc shaped tool (6) is clamped between said first clamping contact surface (17) and said second clamping contact surface (18), said clamping device (8) own only one clamping contact surface which is said first clamping contact surface (17) formed on said first clamping part (13) of said clamping device (8), an anti-rotation structure is formed on said first clamping part (13) and said second clamping part (1).

Said second clamping part (1) is disposed at an end portion which is away from said disc shaped tool (5) and is pressed against thereto, said first clamping contact surface (17) is formed at an ending surface of said first clamping part (13) which is vicinity to said disc shaped tool (5), said flange (2) is provided with thread which is engaged with the according thread that is provided on said spindle (3). A clearance (16) is formed between said second clamping part (1) and said first clamping part (13), whereby said second clamping part (1) is movable along said spindle (3) to compensate a loose space between said second clamping contact surface (18) and said disc shaped tool (5) resulting form the abrupt stop of said spindle (3).

Said anti-rotating structure is composed of at least two anti-rotating bores (15) which is formed on said second clamping part (1) and extended in the axial direction of said spindle (3), and at least two anti-rotating protrusions (14) formed on said first clamping part (13), said at least anti-rotating protrusions (14) is inserted into said at least two anti-rotating bores (15), whereby said second clamping part (1) and said first clamping part (13) is movable with respect to each other in the axial direction of said spindle (3), in the meantime, said at least two anti-rotating bores (15) and said at least two anti-rotating protrusions (14) have a guiding function to the movement of said first clamping part (13) and said second clamping part (1) during said power tool is in operation, and which further have a function of preventing said first clamping part (13) and said second clamping part (1) rotating with respect to each other. In all the FIGS, said elastic element (7) is an o-shaped ring which is made of rubber or synthetic chloroprene rubber or the like materials.

Figure 6:
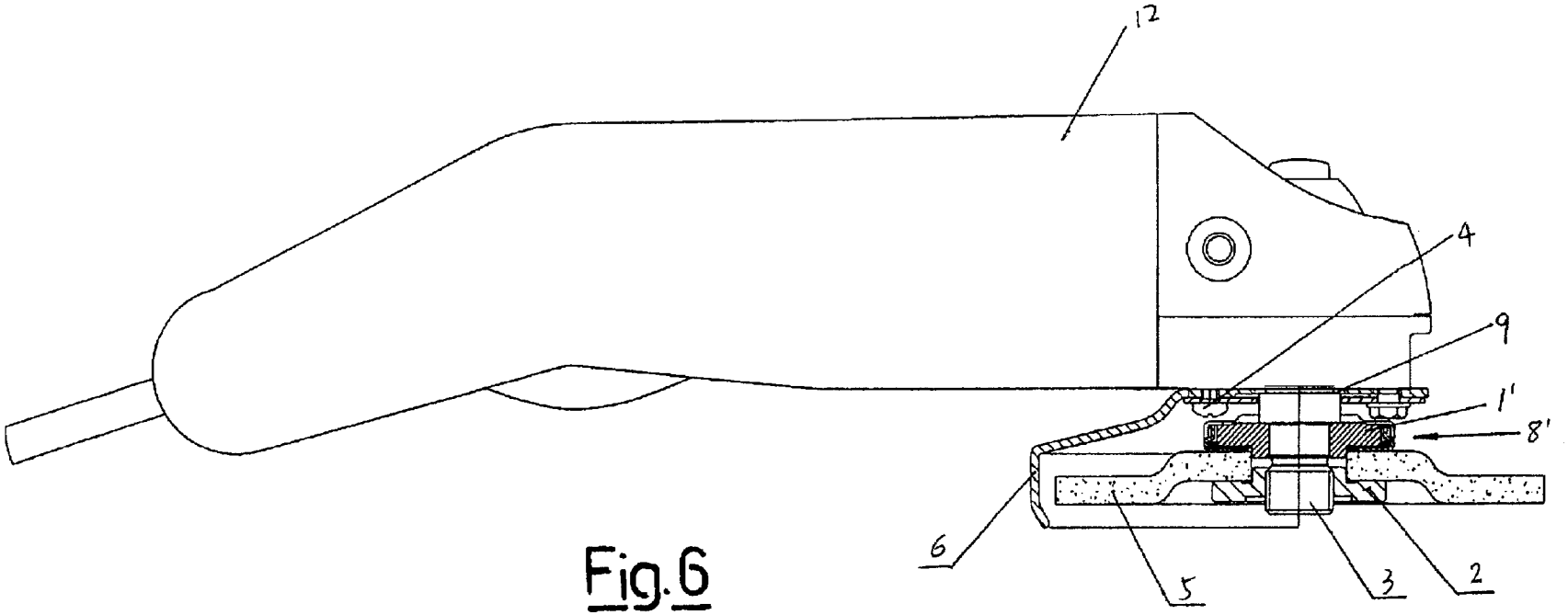
FIG. 6 shows a side view of a second embodiment of the power tool, showing where a disc shaped tool should be fastened.
Figure 7:
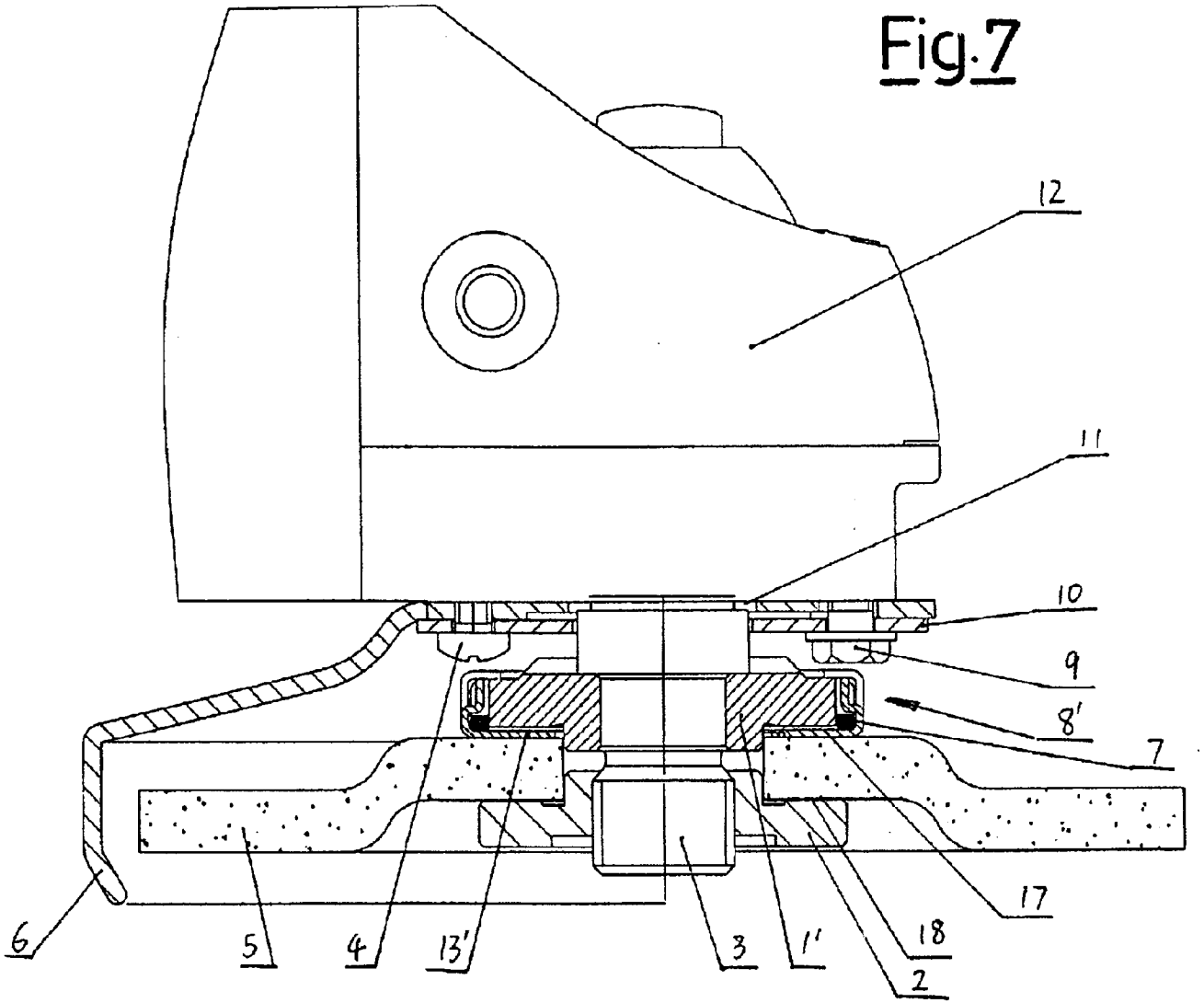
FIG. 7 shows a partly sectional view of a second embodiment of the power tool, showing where a disc shaped tool should be fastened.
Figure 8:
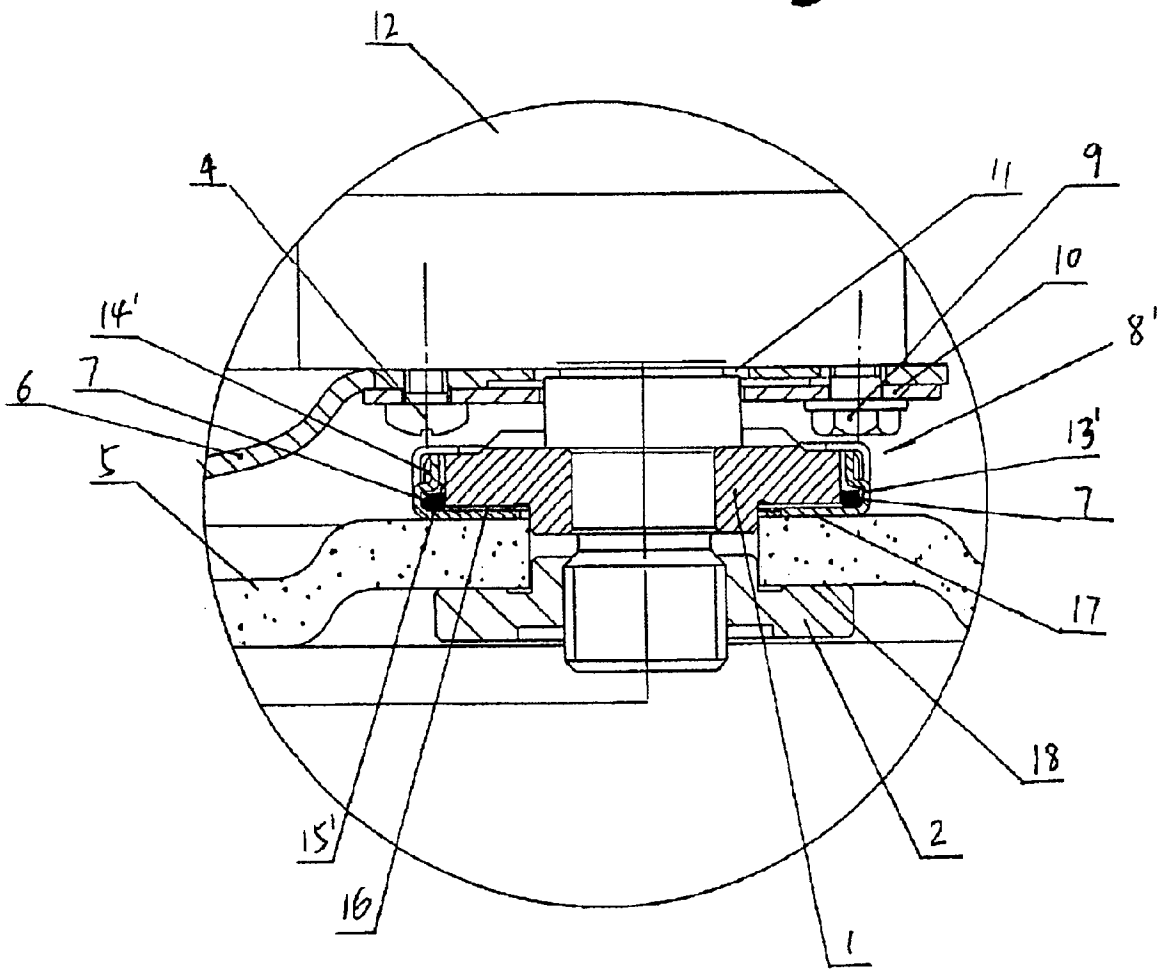
FIG. 8 shows a further enlarged sectional view of the clamping device of FIG. 7.
Figure 9:
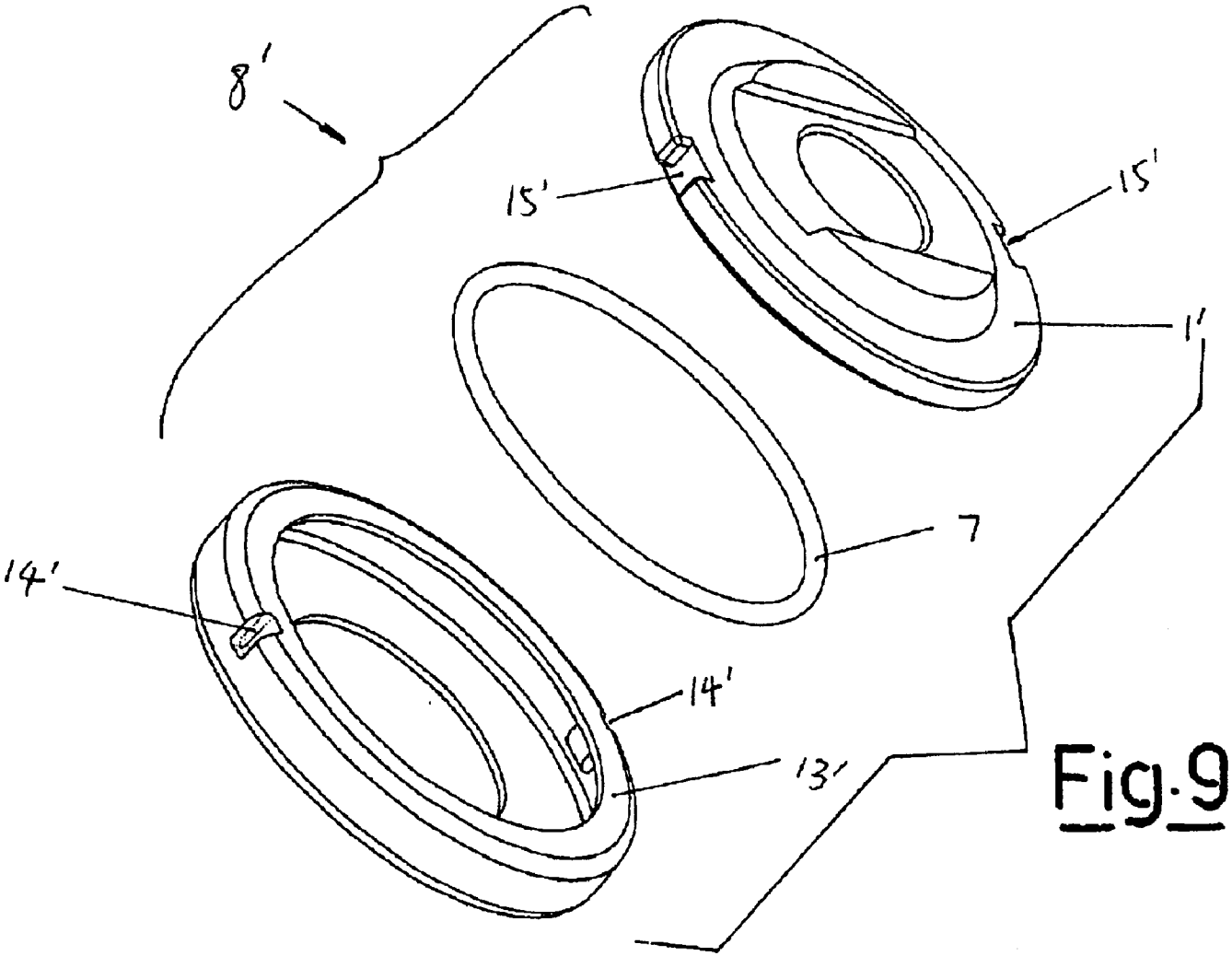
FIG. 9 shows the exploded view of the clamping device of a second embodiment of the power tool.

See FIGS. 6–11, in the second preferred embodiment of the present invention, said anti-rotation structure is composed of at least two outwardly opened notches at the rim portion of said second clamping part (1') and at least two protrusions which is formed on the upper rim portion of said first clamping part (13') and protruded inwards in the radial direction of said first clamping part (13'), said at least two outwardly opened notches (15') are engaged with said at least two protrusions (14') to prevent said first clamping part (13') from rotating with respect to said second clamping part (1'), then the engagement with said at least two outwardly opened notches (15') and said at least two protrusions (14') permit said first clamping part (13') and said second clamping part (1') to move along spindle with respect to each other to compensate the loosing, which is brought by an abruptly stop of said spindle (3), of said flange (2).

What is claimed is:

1. A power tool with a clamping device for axially securing a disc shaped tool, comprising:

a housing (12);

a spindle (3) with thread;

a disc shaped tool (5);

a clamping device (8) and a flange (2) are respectively disposed on each side of said disc shaped tool (5) which is clamped therebetween, said clamping device (8) or said flange (2) is connected to said spindle (3) by thread;

wherein:

said clamping device (8) comprises a first clamping part (13) and a second clamping part (1), an elastic element (7) being disposed between said first clamping part (13) and said second clamping part (1) and providing a clearance (16) between said first and second clamping parts, a first clamping contact surface (17) formed on said first clamping part (13), a second clamping contact surface (18) formed on said flange (2), said disc shaped tool (5) being clamped between said first clamping contact surface (17) and said second clamping contact surface (18), said first and second clamping contact surfaces (17, 18) contact with said disc shaped tool when said clamping device is in its operating position, an anti-rotating structure is disposed between said first clamping part (13) and said second clamping part (1).

2. A power tool with a clamping device for axially securing a disc shaped tool according to claim 1, wherein an end portion of said first clamping part (13) which is away from said disc shaped tool (5) is pressed and touched against said spindle (3), said flange (2) is provided with thread which can be screwed to an outside thread which is provided on said spindle (3).

3. A power tool with a clamping device for axially securing a disc shaped tool according to claim 1, wherein said elastic element (7) is an o-shaped ring made of rubber being resiliently compressed between said first and second clamping parts when said flange (2) engages said spindle (3) with thread.

4. A power tool with a clamping device for axially securing a disc shaped tool according to claim 1, wherein said anti-rotating structure is composed of at least two anti-rotating bores (15) which are formed on said second clamping part (1) and extended in an axial direction of said spindle (3) and at least two anti-rotating protrusions (14) which are formed on said first clamping part (13), said at least two anti-rotating protrusions (14) are inserted into said at least two bores (15) when said clamping device is in its operating condition.

* * * * *